United States Patent [19]

Dulin

[11] 4,130,443

[45] Dec. 19, 1978

[54] APPARATUS FOR CLEANING ROLLER APPLICATORS

[76] Inventor: Henry Dulin, 39 Washington Ave., Whippany, N.J. 07981

[21] Appl. No.: 797,831

[22] Filed: May 17, 1977

[51] Int. Cl.[2] ..... B08B 7/00; B08B 3/00

[52] U.S. Cl. ..... 134/33; 134/140; 134/149

[58] Field of Search ..... 134/139, 140, 149, 153, 134/157, 33, 151, 138, 144

[56] References Cited

U.S. PATENT DOCUMENTS

| | | | |
|---|---|---|---|
| 2,741,857 | 4/1956 | Linatsas | 134/149 |
| 3,462,300 | 8/1969 | Hocutt | 134/33 |
| 3,477,450 | 11/1969 | Berardi | 134/33 |

FOREIGN PATENT DOCUMENTS

| | | | |
|---|---|---|---|
| 2407578 | 9/1974 | Fed. Rep. of Germany | 134/149 |
| 2355843 | 5/1975 | Fed. Rep. of Germany | 134/149 |
| 2360884 | 6/1975 | Fed. Rep. of Germany | 134/138 |

*Primary Examiner*—S. Leon Bashore
*Assistant Examiner*—Chris Konkol

[57] ABSTRACT

Disclosed is a method and apparatus for cleansing roller-type applicators comprising a container, means for supporting and rotating applicators placed inside the container and means for spraying solvent on the rollers. One of the supporting means has a trough which enables the applicator to be cleaned whether or not it is mounted on a handle assembly. To obtain the desired cleaning action, applicators placed inside the container are sprayed with solvent while being held stationary or while being rotated slowly. Thereafter, the applicators are rotated at a high rate of speed to force the solvent with dissolved contaminants out of the applicators.

6 Claims, 3 Drawing Figures

APPARATUS FOR CLEANING ROLLER APPLICATORS

BACKGROUND OF THE INVENTION

1. Field of the Invention

This invention relates to roller applicators of viscous materials such as paint, and more particularly, to apparatus for cleaning such roller applicators to permit repeated use of same.

2. Description of the Prior Art

Most users of roller-type paint applicators attempt to clean used rollers at the end of painting in order to permit reuse of the rollers at some future time. The cleaning process generally involves the removal of paint by the use of scraping, rolling the used applicator roller on an absorbent material, and/or repeatedly immersing the roller in a solvent.

The inefficiency, mess, and waste of time and material associated with the rather crude abovedescribed methods have been realized by many artisans. Consequently, a number of apparatus have been devised and described in the art which attempt to rectify some of the above-mentioned drawbacks of prior art roller cleaning techniques.

One such apparatus, described by S. Feigelman in U.S. Pat. No. 2,965,111, issued Dec. 20, 1960, includes a container having two placement positions for paint rollers and brushes. In the first, low position, the roller is immersed in a pool of solvent; while in the second, high position, the roller is above the solvent. In operation, when in the low position, the roller is shaken or agitated to cause the solvent to dissolve the paint in the roller and to disperse the dissolved paint throughout the solvent. When the solvent is so contaminated that no additional paint is dissolved from the roller and into the solvent pool, the solvent is replaced and the agitation process is repeated. To dry the roller, it is placed in the higher position wherefrom excess solvent drips from the roller into the solvent pool.

A similar approach is employed in the apparatus described by A. Torkelson in U.S. Pat. No. 2,822,814, issued Feb. 11, 1958. Therein, a paint brush to be cleaned is placed in a pool of solvent and is agitated by means of rotation to cause the paint caught in the brush to dissolve and disperse throughout the solvent pool. To dry the brush, it is raised to a position above the solvent pool and is again rotated. The rotation, when in the upper position, causes the paint solvent and the dissolved paint held in the brush to be exepelled from the brush by the centrifugal force of the rotation.

Applying the principles of the Torkelson apparatus, E. S. Cohen in U.S. Pat. No. 2,900,993, issued Aug. 25, 1959, describes an apparatus for cleaning rollers. In accordance with the Cohen description, the paint roller to be cleansed is placed on a moveable shaft. To dissolve the paint on the roller, it is placed in a pool of solvent and is agitated therein by means of a rotational movement. The dissolved paint leaves the high paint concentration paint roller and disperses throughout the low paint concentration solvent pools in accordance with wellknown natural laws. To dry the roller, the shaft upon which the roller is mounted is lifted above the solvent pool and is rotated at high speed to cause the centrifugal force to expel from the roller whatever dissolved paint and solvent is left in the roller.

A study of the above prior art reveals a number of major drawbacks. The first and obvious one is the inefficiency with which the above apparatus use solvent. Clearly, the use of a pool of solvent increases the amount of solvent used in the process of cleaning. The second drawback arises from the mechanical complexities, difficulties in operation, and expense of manufacture associated with the two position concept (one for dissolving and one for drying). Still another drawback manifests itself in the lack of flexibility. None of the prior art apparatus can easily handle both unmounted rollers and rollers mounted on handles.

SUMMARY OF THE INVENTION

It is an object of this invention to clean roller-type applicators with efficient use of solvent.

It is another object of this invention to clean rollers by prime reliance on centrifugal force action.

It is a further object of this invention to clean both mounted and unmounted roller applicators with the same apparatus.

It is still a further object of this invention to clean roller applicators by means of simple, inexpensive to manufacture, and readily portable apparatus.

These and other objects of the invention are achieved with an apparatus comprising a container for inserting rollers therein, means for supporting and rotating the rollers placed inside the container and means for spraying solvent on the rollers. To obtain the desired cleaning action, rollers are sprayed with solvent while being held stationary or while being rotated slowly, and following a short time to allow for absorption and dissolving of the contaminants, the rollers are rotated at a high rate to force the solvent with the dissolved contaminants out of the rollers.

DETAILED DESCRIPTION

Construction

Figure 1:
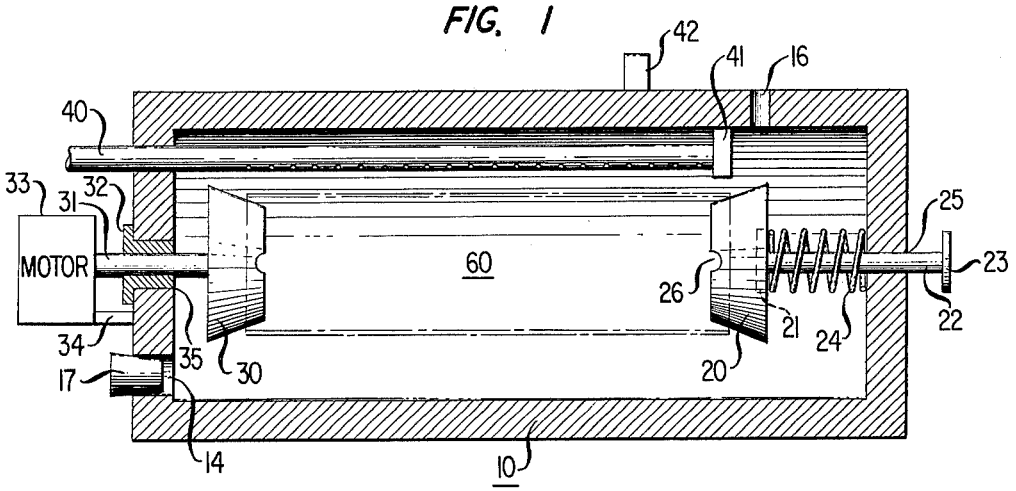
FIG. 1 depicts one embodiment of a cleaning apparatus in accordance with the principles of this invention when holding an unmounted roller.
Figure 3:
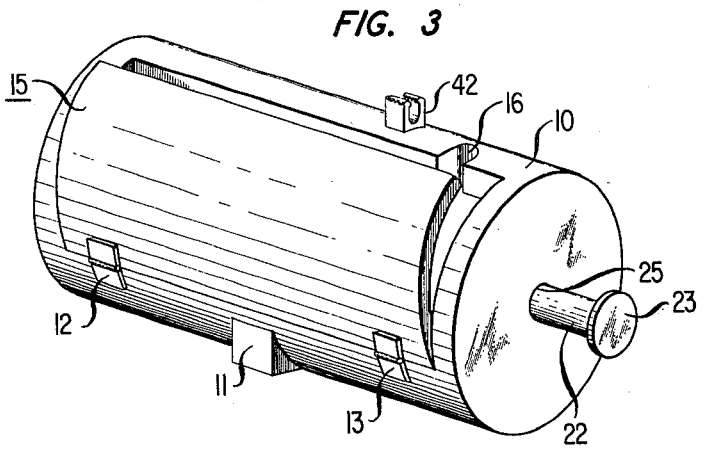
FIG. 3 is a perspective drawing of container 10 in the apparatus of FIG. 1.

Referring to FIG. 1, container 10, which is drawn in a cutaway view to better show the internal mechanism, is the housing within which paint rollers are cleansed. It may be cylindrical in shape, box-like, or of any other convenient shape. FIG. 3 depicts container 10 in a cylindrical form, with a protrusion 11 in the cylinder's wall serving to prevent container 10 from rolling. A portion of the cylinder's wall is cut away from the cylinder forming an opening. The cut section, 15, is hinged on one side of the opening in a door-like fashion with spring-loaded hinges 12 and 13 causing the door-like section 15 to close the opening. The size and location of the opening is not critical as long as the opening is large enough to conveniently manipulate a paint roller through it. In FIG. 3, the opening and the door-like section 15 takes up, approximately, the upper front quarter of the cylindrical wall of container 10.

Getting back to FIG. 1, in addition to the door-like section 15, container 10 includes a hole in each circular side panel of cylindrical container 10 (25 and 35), some means for removing contaminated solvent, such as hole 14 which may be plugged with stopper 16, a hole for inserting a pipe into container 10 (described in more detail hereinafter), and a slot (16) adapted for accepting the frame of a roller handle mechanism. As shown in FIG. 3, slot 16 begins at the opening in the cylinder wall of container 10 and is slightly longer than it is wide. Slot 16 is located away from the center of container 10 and closer to hole 25 in the container's side panel. The distance of slot 16 from the center of container 10 is equal to the distance from the center of a roller, when mounted on a handle mechanism, to the frame portion of the handle that is perpendicular to the axis of the roller. In roller mechanisms adapted for nine-inch rollers, this distance is approximately 5¼ inches. To hold the roller mechanism in place, the outside of container 10 includes a fastener 42 located approximately at the container's center.

Container 10 further includes three assemblies in its interior: an active support means associated with roller support 30 and shaft 31 passing through hole 35, a passive support means associated with roller support 20 and shaft 22 passing through hole 25, and a pipe 40 placed above the support means and along an axis which is basically parallel to the cylinder's axis.

Holes 25 and 35 in the circular side panels of container 10 are placed away from the cylindrical walls by at least the radius of the rollers cleansed in container 10 and must have their centers lie on the same axis (which need not coincide with the axis of cylindrical container 10 but which conveniently ought to be parallel thereto).

The passive support means of the apparatus illustrated in FIG. 1 comprises a roller support 20 which is intended to support a spinning roller, a bearing 21, a shaft 22, a cylindrical compression spring 24, and a stop plate 23.

To provide a convenient support for rollers, roller support 20 is constructed in the form of a truncated cone, not unlike a cork stopper, with the base diameter being larger than the diameter of rollers expected to be used, and the truncated apex diameter being smaller than the diameter of rollers expected to be used. With such a construction for roller support 20, unmounted rollers engaged with support 20 have their axis coincide with the axis of the truncated cone. In order to support mounted rollers, support 20 includes at least one slot, or trough, 26, in the circular plane formed by the truncated apex. Trough 26 passes through the center of the circular plane, and most conveniently, it is a single slot bisection of the circular plane. Of course, other fairly simple structures for support 20 are possible.

To allow for low frictional spinning about the truncated cone axis of roller support 20, bearing 21 is lodged in the center of the support's base and shaft 22 is pressed into bearing 21. To mount the passive support means into housing 10, shaft 22 is passed through spring 24 and inserted into hole 25. To secure shaft 22 in hold 25, stop plate 23 is attached to the end of shaft 22 by means of a screw or any other convenient means. For a more permanent connection, plate 23 may be welded onto shaft 22, a C spring clamp may be placed on shaft 22 or the shaft itself may be deformed to prevent it from sliding out of hole 25. To facilitate cleaning of the passive support assembly, I contemplate the use of a C spring clamp or a removeable plate 23.

The active support means of the apparatus illustrated in FIG. 1 comprises roller support 30, shaft 31, bushing 32, motor 33, and motor support 34.

Roller support 30 most conveniently is identical in its construction to roller support 20, except that unlike shaft 22, shaft 31 is permanently attached to the center of the base in support 30. Thus, roller support 30 is spinned by rotating shaft 31. To facilitate spinning of support 30, bushing 32 is placed in hole 35 and shaft 31 is extended to the outside of container 10 through bushing 32. The shaft of motor 33 is coupled to shaft 31, and motor 33 is attached to container 10 with motor support 34. Activation of motor 33 causes shaft 31 and roller support 30 to spin, which in turn causes whatever roller is engaged to support 30 to also spin.

Although FIG. 1 depicts the active support means to include a motor (33) located on the outside of container 10, it should be clear that any means for rotating support 30 are within the contemplation of this invention. For example, motor 33 may be placed inside container 10, eliminating thereby hole 35 and bushing 32. Alternatively, motor 33 itself may be replaced by a manual crank with or without assistance from a gear arrangement as commonly found in hand operated grinding wheel assemblies or from a pulley arrangement as shown, for example, in the above referenced Torkelson patent.

Pipe 40, as indicated previously, is placed above the passive and active support means and runs along an axis parallel to the long axis of container 10. One end of pipe 40 passes through a hole in container 10 (shown passing in FIG. 1 through the side panel of the active support means) and the other end of pipe 40 (close to the side panel of the passive support means) is blocked and attached to container 10 with support post 41. Pipe 40 is made with perforated holes directed downward. Consequently, when a solvent is forced into the pipe it sprays out of the pipe and onto whatever roller is engaged between the active and passive support means.

Operation

As indicated previously, one of the advantages characterizing my apparatus for cleaning rollers relates to the fact that both mounted and unmounted rollers may be cleansed.

To clean an unmounted roller 60 (FIG. 1) which generally has the shape of a tube, door section 15 is opened and roller 60 is inserted and engaged between the active and passive support means. This is done in two steps. First, one end of the roller is mounted onto roller support 30 much like the neck of a wine bottle is pushed onto a cork. Then, support 20 is pushed along its rotational axis to force shaft 22 out of container 10 (increasing thereby the space between supports 20 and 30). After roller 60 is aligned between supports 20 and 30, support 20 is released, permitting spring 24 to push roller support 20 into the other end of the roller. Closing of door section 15 and blocking hole 14 with stopper 16 completes the preparation for roller cleaning.

The actual cleaning proceeds by causing motor 33 to slowly rotate shaft 31 and by forcing a cleansing liquid into pipe 40. Rotation of shaft 31 causes roller support 30 to rotate, and since roller 60 is frictionally engaged to support 30, it too rotates, together with support 20 which rotates about bearing 21. Forcing of cleansing liquid into the perforated blind pipe 40 sprays the cleansing fluid over the slowly rotating roller 60. Once roller 60 is saturated with the cleansing fluid, motor 33 is made to rotate at a high rate of speed and the centrifugal forces generated expel all liquid with the dissolved contaminants from the roller. The steps of saturation roller 60 with cleansing fluid and expelling the fluid by centrifugal forces may be repeated as many times as desired.

Figure 2:
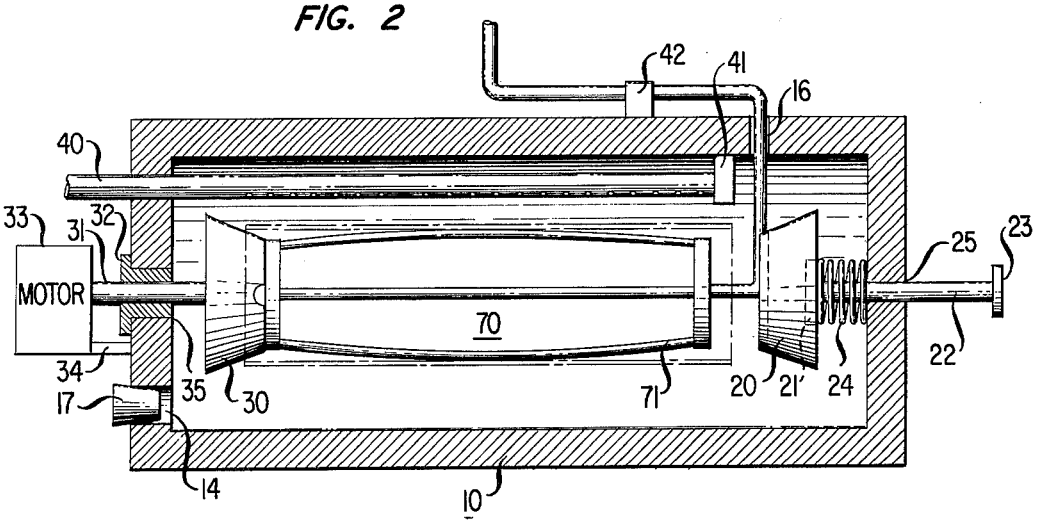
FIG. 2 depicts the cleaning apparatus of FIG. 1 when holding a roller mounted on a handle mechanism.

FIG. 2 depicts the apparatus of FIG. 1 when arranged to clean a roller assembly 70 which comprises a roller mounted on a roller frame and handle. The placement of roller assembly 70 into container 10 is very similar to the placement of roller 60, in that the roller is first engaged with roller support 30, support 20 is pushed to increase the separation between supports 20 and 30, the roller is aligned, and support 20 is released to engage the roller. The actual engagement processes of roller assembly 70 to supports 20 and 30 differ, however, between roller 60 and roller assembly 70 because roller 60 is unmounted whereas roller 70 is mounted on a handle assembly.

When roller 70 is mounted on a handle assembly, one end of the roller appears free while the other end of the roller is axially connected to the handle frame. At close proximity to this other end of the roller, the frame bends 90° to be perpendicular to the roller's axis, and shortly thereafter, the frame bends 90° again to be parallel to the roller's axis and projecting towards the roller's center.

In accordance with FIG. 2, the free end of roller 70 is engaged to roller support 30 in the manner identical to the engagement of support 30 to roller 60. In assemblies where the hollow opening in the free end of the roller is blocked, roller support 30 engages the blocked opening. To engage the end of roller 70, which is connected to the frame, the groove or slot 26 in roller support 20, which was described above, is aligned to accept the roller's frame and is positioned so that the mounted roller's axis approximately aligns with the axis of roller support 20.

The remainder of the handle assembly of roller 70 is placed outside container 10 by inserting the frame into slot 16 before closing door assembly 15 and by supporting the frame outside container 10 with support 42.

The actual cleansing of roller 70 follows the exact procedure followed in cleansing roller 60.

What is claimed is:

1. Apparatus adapted for cleaning unmounted as well as mounted paint roller type applicators comprising:
   - a closeable container;
   - a first support means in said container for engaging a first end of an applicator whether or not said applicator is mounted on a handle assembly;
   - a second support means in said container for engaging a second end of said applicator whether or not said applicator is mounted on a handle assembly;
   - means in the interior of said container for spraying said applicator with solvent; and
   - means for rotating said applicator to cause contaminated solvent to be expelled from said applicator by centrifugal force.

2. The apparatus of claim 1 wherein said first and second support means are rotatable about a common rotational axis.

3. The apparatus of claim 2 wherein said first and second support means have the shape of a truncated cone with their respective axes coincident with said common rotational axis and at least one of said truncated cone support means has a trough in its smaller base, adapted to accept the frame of a handle assembly.

4. The apparatus of claim 3 wherein said first support means is an active support means and said second support means is a passive support means.

5. The apparatus of claim 4 wherein said active support means is engaged to said means for rotating, and said passive support means is spring loaded and capable of movement along its rotational axis.

6. The apparatus of claim 1 further including an opening for permitting the handle and part of the frame of a roller mounted on a handle frame assembly to extend outside said container.

* * * * *